US010507850B2

(12) United States Patent
Kontetzki et al.

(10) Patent No.: US 10,507,850 B2
(45) Date of Patent: Dec. 17, 2019

(54) DEVICE FOR CONNECTING A COUPLING SHAFT TO A CAR BODY OF A TRACK-GUIDED VEHICLE

(71) Applicant: VOITH PATENT GMBH, Heidenheim (DE)

(72) Inventors: Arthur Kontetzki, Salzgitter (DE); Eckart Jäde, Braunschweig (DE)

(73) Assignee: VOITH PATENT GMBH, Heidenheim (DE)

( * ) Notice: Subject to any disclaimer, the term of this patent is extended or adjusted under 35 U.S.C. 154(b) by 203 days.

(21) Appl. No.: 15/575,426

(22) PCT Filed: May 12, 2016

(86) PCT No.: PCT/EP2016/060666
§ 371 (c)(1),
(2) Date: Nov. 20, 2017

(87) PCT Pub. No.: WO2016/188758
PCT Pub. Date: Dec. 1, 2016

(65) Prior Publication Data

US 2018/0154912 A1 Jun. 7, 2018

(30) Foreign Application Priority Data

May 26, 2015 (DE) ..... 10 2015 108 228

(51) Int. Cl.
*B61G 9/24* (2006.01)
*B61G 9/06* (2006.01)

(52) U.S. Cl.
CPC *B61G 9/24* (2013.01); *B61G 9/06* (2013.01)

(58) Field of Classification Search
CPC ... B61G 7/10; B61G 9/10; B61G 9/24; B61G 11/16
See application file for complete search history.

(56) References Cited

U.S. PATENT DOCUMENTS 3,906,868 A * 9/1975 Ksiensyk ..... B61G 7/10 213/64
4,136,787 A * 1/1979 Forster ..... B61G 7/12 213/40 R (Continued)

FOREIGN PATENT DOCUMENTS

CN 101142115 A 3/2008
CN 101985302 A 3/2011

(Continued)

*Primary Examiner* — Zachary L Kuhfuss
(74) *Attorney, Agent, or Firm* — Shumaker, Loop & Kendrick, LLP; James D. Miller

(57) ABSTRACT

A device for connecting a coupling shaft to a car body of a track-guided vehicle, wherein the device includes a linkage connected to the coupling shaft and a bearing block connectable to the car body to which the linkage is articulated by means of at least one pivot pin so as to be pivotable in a horizontal plane. At least one pivot pin is designed as a shock protector and thereto comprises a bearing disc having a concentrically arranged recess and a shearing element having a breaking or separating region. A bearing block-side region of the shearing element is accommodated in the recess of the bearing disc and a linkage-side region of the shearing element is accommodated in a pin seat of the linkage.

19 Claims, 6 Drawing Sheets

(56) References Cited

U.S. PATENT DOCUMENTS

| | | | | |
|---|---|---|---|---|
| 6,315,139 | B1 * | 11/2001 | Kreher | B61G 9/06 213/9 |
| 7,513,376 | B2 * | 4/2009 | Sprave | B61G 7/14 213/75 R |
| 7,552,830 | B2 * | 6/2009 | Radewagen | B61G 7/14 213/9 |
| 8,051,995 | B2 * | 11/2011 | Kontetzki | B61G 9/06 213/1 A |
| 8,714,377 | B2 * | 5/2014 | Peckham | B61G 11/16 213/22 |
| 9,440,664 | B2 * | 9/2016 | Liu | B61G 7/14 |
| 9,878,728 | B2 * | 1/2018 | Stroud | B61G 7/10 |
| 10,246,108 | B2 * | 4/2019 | Nikolaus | B61G 7/10 |
| 10,266,186 | B2 * | 4/2019 | Beck | B61G 7/10 |
| 10,308,262 | B2 * | 6/2019 | Westman | B61G 9/24 |
| 10,308,263 | B1 * | 6/2019 | Ring | B61G 9/10 |
| 2012/0031299 | A1 * | 2/2012 | Kontetzki | B60R 19/34 105/392.5 |
| 2015/0008208 | A1 * | 1/2015 | Liu | B61G 7/14 213/221 |
| 2015/0069002 | A1 * | 3/2015 | Stroud | B61G 7/10 213/7 |
| 2016/0272224 | A1 * | 9/2016 | Beck | B61G 7/10 |
| 2016/0318528 | A1 * | 11/2016 | Westman | B61G 9/24 |
| 2018/0154912 | A1 * | 6/2018 | Kontetzki | B61G 9/06 |
| 2018/0208007 | A1 * | 7/2018 | Eliasson | B60D 1/145 |
| 2019/0061790 | A1 * | 2/2019 | Wipfler | B61G 9/10 |

FOREIGN PATENT DOCUMENTS

| | | | |
|---|---|---|---|
| CN | 101142115 | B | 4/2012 |
| CN | 103068664 | A | 4/2013 |
| CN | 204172922 | U | 2/2015 |
| DE | 202013005377 | U1 | 6/2013 |
| EP | 1719684 | A1 | 11/2006 |
| EP | 1785330 | A1 | 5/2007 |
| EP | 2072370 | A1 | 6/2009 |
| EP | 2522560 | A1 | 11/2012 |
| WO | 2013134920 | A1 | 9/2013 |

* cited by examiner

DEVICE FOR CONNECTING A COUPLING SHAFT TO A CAR BODY OF A TRACK-GUIDED VEHICLE

CROSS-REFERENCE TO RELATED PATENT APPLICATIONS

This patent application is a United States national phase patent application based on PCT/EP2016/060666 filed May 12, 2016, which claims the benefit of German Patent Application No. DE 10 2015 108 228.4 filed May 26, 2015, the entire disclosures of which are hereby incorporated herein by reference.

FIELD

The invention relates in particular to a device for connecting a coupling shaft to a car body of a track-guided vehicle, particularly a rail-mounted vehicle, wherein the device comprises a linkage connected to the car body-side end region of the coupling shaft and a bearing block connected or connectable to the car body to which the linkage is articulated by means of at least one pivot pin so as to be pivotable in a horizontal plane.

BACKGROUND

This type of device is already known in principle from rail vehicle technology. In this regard, reference is made for example to the DE 20 2013 005 377 U1 printed publication.

Specifically, this prior art relates to a central buffer coupling for rail-mounted vehicles in which the coupling shaft of the central buffer coupling is articulated to the end face of a car body by a linkage so as to be pivotable in a horizontal direction. An elastomer spring mechanism is integrated into the linkage itself which serves in absorbing the tractive and impact forces occurring in normal driving conditions of the rail-mounted vehicle and being transmitted to a bearing block via the coupling shaft and the linkage.

The linkage known from DE 20 2013 005 377 U1 is moreover provided with a shock protector designed such that the connection between the linkage and the bearing block disengages upon the exceeding of a definable critical impact force transmitted via the coupling shaft and the linkage to the bearing block so that at least part of the coupling shaft can be taken out of the flow of forces transmitted to the bearing block. A shearing device comprising a plurality of shearing elements is used to this end by means of which the linkage, and specifically the housing of the elastomer spring mechanism of the linkage, is connected to correspondent vertically extending pivot pins.

The implementation of the shearing device with the linkage or respectively the housing of the elastomer spring mechanism being connected to the bearing block in the solution known from DE 20 2013 005 377 U1 can be regarded as being problematic. Specifically, the shearing device in the known prior art is realized by a plurality of shear pins (shearing elements), whereby the connection between the linkage and the bearing block is not disengaged until all the shearing elements have been activated and have lost their function as connecting elements. This assumes, however, that all the shearing elements are activated as simultaneously as possible upon the exceeding of a critical impact force transmitted from the linkage to the bearing block.

In practice, however, this condition cannot be realized or can only be realized at great effort since the load distributions on the shear pins employed as shearing elements is usually unknown and often uneven due to the elasticities and manufacturing tolerances in the system.

Moreover, the shearing elements (shear pins) employed in DE 20 2013 005 377 U1 not only serve solely as shock protection but also to connect the respective vertically extending pivot pins to the linkage, or the elastomer spring mechanism housing respectively, under normal conditions; i.e. when transmitting non-critical impact forces. The influence of the selected pretensioning of the pins on the response behavior and particularly the actuation force of the pins has to thereby be taken into account. Since the actuation force usually disperses, this additionally hampers realizing a simultaneous responding of the individual shearing elements upon a critical impact force being exceeded.

Moreover, only a lesser pin pretensioning is systematically possible in the case of pins concurrently serving as shearing elements compared to normal pins, which increases the risk of fatigue failure and the bolts working themselves loose.

SUMMARY

On the basis of this problem as defined, the present invention is based on the task of further developing a device of the type cited at the outset for connecting a coupling shaft to a car body of a track-guided vehicle such that the connection between the linkage and the bearing block formed by the at least one pivot pin is disengaged in as simple and yet most effective manner possible upon the exceeding of a critical impact force transmitted from the linkage to the bearing block, wherein the response behavior of this overload protection is as precisely predefinable as possible.

Accordingly, it is in particular provided for the at least one pivot pin, via which the linkage is articulated to the bearing block so as to be pivotable in a horizontal plane, to itself be designed as a shock protector so that upon the exceeding of a definable critical impact force transmitted via the coupling shaft and the linkage to the bearing block, the connection between the linkage and the bearing block formed by the at least one pivot pin is disengaged.

To this end, it is inventively provided for the at least one pivot pin to comprise a bearing disc having a concentrically arranged recess and a shearing element having a predetermined breaking or separating region, wherein said predetermined breaking or separating region divides the shearing element into a bearing block-side region and an oppositely disposed linkage-side region. The bearing block-side region of the shearing element is at least partly accommodated in or connected to the recess of the bearing disc while the linkage-side region of the shearing element is at least partly accommodated in at least one pivot pin-associated pin seat of the linkage and connected as applicable to the pin seat of the linkage.

The solution according to the invention in particular provides for at least one region of the peripheral edge of the bearing disc to form a sliding surface for a pivot bearing formed in the bearing block.

The advantages able to be achieved with the inventive solution are obvious: Dispensing with shear pins which need to fulfill the function of connecting the linkage or, respectively, connecting the housing of the elastomer spring device to the correspondent vertically extending pivot pins in addition to functioning as overload protection enables the inventive solution to only have to assign one single function to the shearing element so that this component is only subject to one type of stress (in the present case, shearing force). As already described at the outset, this is not the case with the overload protection proposed in DE 20 2013 005 377 U1 as there the shear pins employed are systematically subject to multiple types of stress (pretensioning and transverse stress). In contrast thereto, the solution according to the invention enables optimally predimensioning the shearing element integrated into or forming a part of the pivot pin along with its breaking or separating region.

One preferential realization of the inventive solution provides for at least one feather key inserted in an elongated feather key groove extending parallel to the direction of the coupling shaft. The configuration of the feather key groove in the bearing disc on the one hand and in the linkage on the other is such that the feather key lodged in the feather key groove transmits torque acting on the linkage to the bearing disc upon the horizontal pivoting of the coupling shaft.

In order to achieve a symmetrical linkage structure in terms of the vertical axis of rotation defined by the at least one pivot pin, it is in this context advantageous for at least two feather keys to be allocated to the at least one pivot pin, each in an elongated feather key groove laterally spaced from the vertical rotation axis defined by the pivot pins and extending parallel to the coupling shaft direction.

The at least one feather key is preferably a solid elongated metal piece rectangular in cross section which is inserted into the respective feather key groove formed in the bearing disc and linkage. The feather key thereby bears on their sides in positive engagement, thus acting as a driver, and transfers a torque acting on the linkage upon the horizontal pivoting of the coupling shaft to the bearing disc of the pivot pin.

The respective feather key groove formed in the linkage is preferably of open design to the coupling shaft so that the feather key does not obstruct the linkage from moving toward the car body and relative to the bearing block upon the exceeding of a critical impact force transmitted to the bearing block via the coupling shaft and the linkage and the activation of the shearing element.

Particularly preferentially, the bearing block of the device according to the invention comprises a bearing shell allocated to the at least one pivot pin in which the bearing disc of the pivot pin is at least partially accommodated so as to produce a floating bearing and at least one section of the peripheral edge of the bearing disc forms the sliding surface. A floating bearing of the pivot pin in the associated bearing shell of the bearing block has the advantage of the pivot pin, or the bearing disc of the pivot pin respectively, being able to be inserted into the respective bearing shell of the bearing block without force such that the pivot pin is not loaded with transverse force which would affect the actuation force of the shearing element.

In order to hold the at least one pivot pin, which is preferably in a floating fit in the bearing shell of the bearing block, in its position, one preferential further development of the inventive solution provides for the bearing block to comprise a cover for the bearing shell associated with the at least one pivot pin, whereby the cover is preferably detachably connected to the bearing block such that the bearing shell of the bearing block and the cover define a volume in which the bearing disc of the pivot pin is accommodated.

The term "bearing disc" as used herein is in particular to be understood as a cylindrical or conical, rotationally symmetric component, having a radius which is preferably greater than its thickness. The bearing disc exhibits a concentric recess or corresponding bore in which at least part of the bearing block-side region of the shearing element is accommodated.

According to embodiments of the inventive solution, at its end face opposite the linkage; i.e. the end face of the bearing disc without the concentric recess/bore, the bearing disc comprises a cylindrical plate region, the radius or diameter of which is greater than the diameter of the peripheral edge of the bearing disc and greater than the diameter of the bearing shell of the bearing block allocated to the pivot pin. This cylindrical plate region simplifies the positioning of the pivot pin in preferably floating bearing in the bearing shell of the bearing block.

As described above, it is conceivable according to one aspect of the present invention for at least one feather key to be provided which is inserted in an elongated feather key groove extending parallel to the coupling shaft direction, whereby this feather key groove is configured in the bearing disc on the other hand and in the linkage on the other such that the feather key inserted into the feather key groove serves as a driver element for transferring torque acting on the linkage to the bearing disc upon a horizontal pivoting of the coupling shaft.

Alternatively (or also additionally) thereto, it is conceivable according to a further aspect of the present invention for the bearing block-side region of the shearing element to be connected to the bearing disc by means of at least one bolt or similar fixing element.

Alternatively or additionally thereto, the linkage-side region of the shearing element can also be connected to the linkage by at least one bolt or similar fixing element.

Particularly in these embodiments, it needs to be ensured that the bolts used to connect the shearing element to the bearing disc/linkage are in each case of short enough configuration as to not extend over the breaking or separating region of the shearing element when in the bolted state. Doing so thus ensures that the bolts are not arranged in the flow of force transmitted from the shearing element of the pivot pin but are instead free of force so as to prevent impacting the response behavior of the shearing element.

One preferential realization of the inventive solution provides for the depth of the recess formed in the bearing disc and/or the position of the breaking or separating region formed in the shearing element to be selected such that at least the car body-side peripheral edge of the bearing disc does not cover the linkage-side region of the shearing element. This thus ensures that the bearing disc peripheral edge blocks or at least hinders the linkage from moving toward the car body relative to the bearing block upon shearing element activation; i.e. when the shearing element loses its connecting function and the linkage-side region of the shearing element separates from the bearing block-side region of the shearing element at the breaking or separating region.

One preferential further development of the latter embodiment provides for a coupling shaft-side region of the bearing shell peripheral edge to at least partially cover the linkage-side region of the shearing element. A tensile load protection is thereby formed, since under tractive loading; i.e. when tensile force is transmitted from the coupling shaft to the linkage and from there to the bearing block, it will be at least partially transferred from the linkage-side region of the shearing element to the peripheral edge of the bearing disc and from there to the bearing block. In other words, at least a part of the force transmitted under tractive loading is directed past the shearing element of the pivot pin.

With respect to the breaking or separating region of the shearing element, it is advantageously provided for same to comprise at least one groove introduced into the material of the shearing element. This thereby constitutes a particularly easily realized solution for forming a breaking or separating region having precisely predictable response behavior.

The at least one groove can for example be introduced into the outer surface of the shearing element, which may have advantages in terms of the production of the shearing element and the formation of the breaking or separating region.

However, it is particularly preferentially provided for the bearing block-side region and/or the linkage-side region of the shearing element to be at least partially of hollow design, whereby the at least one groove forming the breaking or separating region is designed as an internal groove. This can thereby at least partially reduce bending slot tension during the shearing process, which even further optimizes the response behavior of the shearing element.

Of course it is however also possible in this context to provide both a groove in the outer surface of the shearing element as well as an internal groove in order to form the breaking or separating region of the shearing element.

Particularly preferentially, the recess formed in the bearing disc is of circular cylindrical or conical shape, wherein the bearing block-side region of the shearing element exhibits a respectively complementary shape. In the same way, is it advantageous for the pin seat of the linkage associated with the at least one pivot pin, in which the linkage-side end region of the shearing element is accommodated and connected as applicable to the linkage, to be of circular cylindrical or conical shape, wherein the linkage-side region of the shearing element likewise exhibits a respectively complementary shape.

BRIEF DESCRIPTION OF THE DRAWINGS

The following will reference the drawings in describing example embodiments of the invention in greater detail.

Shown are.

DETAILED DESCRIPTION OF THE EMBODIMENTS

Figure 1:
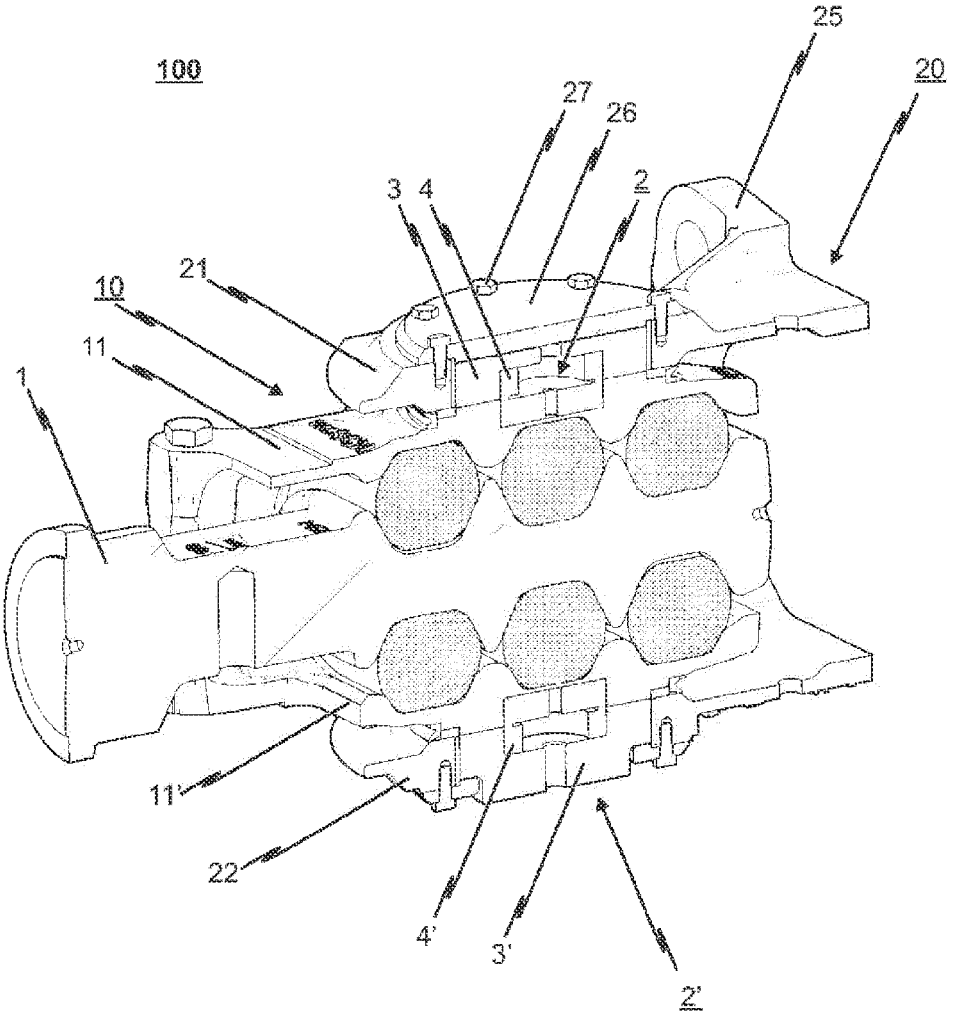
FIG. 1 an isometric and longitudinally sectioned representation of a first example embodiment of the device according to the invention.
Figure 2:
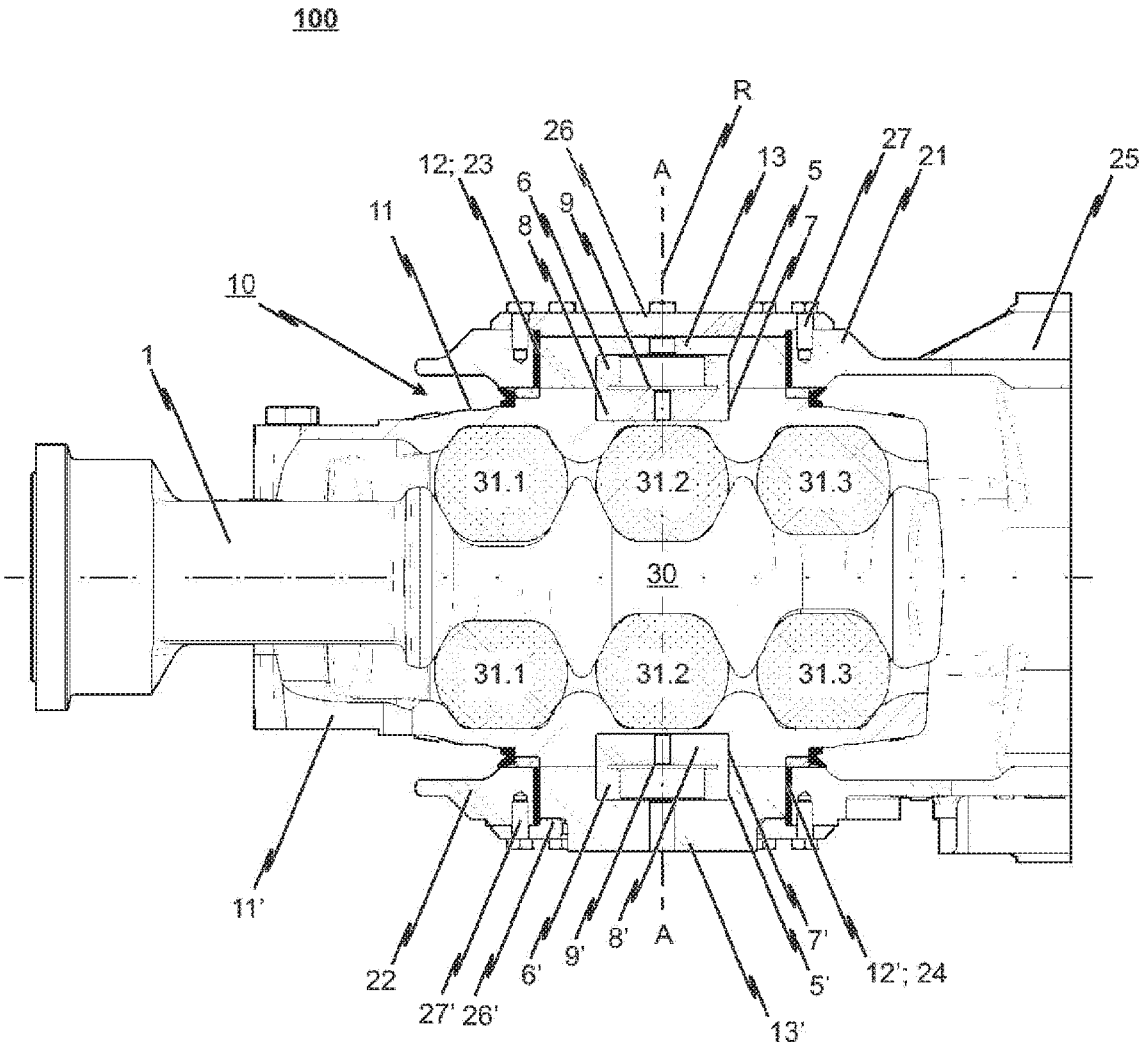
FIG. 2 the device according to FIG. 1 in a side sectional view.

FIG. 1 shows a first example embodiment of the inventive device 100 for connecting a coupling shaft 1 to a (not depicted) car body of a track-guided vehicle, particularly a rail-mounted vehicle, in an isometric and longitudinally sectioned view, whereby the car body-side end region of the coupling shaft 1 is only implied in FIG. 1. FIG. 2 shows the device 100 according to FIG. 1 in a side sectional view.

As depicted, the first example embodiment of the inventive device 100 provides for same to comprise a linkage 10 connected to the car body-side end region of the coupling shaft 1 and a bearing block 20 connectable to the car body of the track-guided vehicle.

An elastomer spring mechanism 30 which comprises three spring elements 31.1, 31.2, 31.3 in the example embodiment depicted in the drawings is integrated into the linkage 10. The spring elements 31.1, 31.2, 31.3 are configured such that tensile and impact forces are absorbed up to a defined magnitude and forces which exceed that are relayed on to the vehicle undercarriage (not depicted in the drawings) via the bearing block 20.

The linkage 10 is designed and serves to articulate the coupling shaft 1 of a central buffer coupling to the bearing block normally mounted to the end face of a car body so as to be pivotable in a horizontal plane.

In the embodiment of the device 100 depicted as an example in the drawings, the bearing block 20 comprises a flange region 25, via which the bearing block 20 can be connected to the car body of the track-guided vehicle. The bearing block 20 further comprises an upper and a lower bearing block arm 21, 22, in each of which a respective bearing block shell 23, 24 is formed to receive corresponding pivot pins 2, 2' of the linkage 10. The bearing block shells 23, 24 thereby run substantially horizontally while the flange region 25 of the bearing block 20 lies in a vertical flange plane distanced from the vertical rotation axis R defined by the bearing shells 23, 24 in the direction of the car body.

As previously indicated, the linkage 10 employed in the embodiment of the inventive device 100 depicted as an example in the drawings comprises a drawgear in the form of an elastomer spring mechanism 30. This elastomer spring mechanism 30 comprises a housing open toward the (not shown) coupler head and consisting of two housing shells 11, 11'. The rear end of the coupling shaft 1 extends coaxially into the housing formed by the housing shells 11, 11' of the elastomer spring mechanism 30 serving as a drawgear housing at a radial spacing from the inner peripheral surface of the housing. The rear end of the coupling shaft 1 is thereby articulated to the correspondent bearing block arms 21, 22 of the bearing block 20 via the spring elements 31.1, 31.2, 31.3 of the elastomer spring mechanism 30 and the correspondent housing shells 11, 11' so as to be pivotable in a horizontal plane.

The pretensioned spring elements 31.1, 31.2, 31.3 consisting of an elastic material are provided between the inner peripheral surface of the housing and with their center planes aligned vertically and equidistantly arranged one behind the other in the longitudinal direction of the coupling shaft 1. Both the rear region of the coupling shaft 1 as well as the inner surfaces of the housing shells 11, 11' exhibit circumferential annular beads facing one another. The annular beads are configured such that the spring elements 31.1, 31.2, 31.3 are in each case held in interstices between two adjacent annular beads against the rear end region of the coupling shaft 1 and the housing.

Because each spring element 31.1, 31.2, 31.3 rests directly against both the peripheral surface of the coupling shaft 1 as well as the inner peripheral surface of the housing, this enables achieving a cardanic motion of the coupling shaft 1 relative to the housing shells 11, 11' on the one hand and, on the other, the spring elements 31.1, 31.2, 31.3 of the elastomer spring mechanism 30 being able to accommodate and absorb up to a predefined magnitude of tensile and impact forces.

The respective housing shells 11, 11' are connected to the corresponding bearing block arms 21, 22 such that the housing of the elastomer spring mechanism 30 can pivot in a vertical plane relative to the bearing block 20. To this end, a respective pivot pin 2, 2' is employed in the embodiment of the inventive device 100 depicted as an example in the drawings.

The solution according to the invention provides for designing the pivot pins 2, 2' utilized for the articulated connection of the housing of the elastomer spring mechanism 30 to the bearing block 20 as shock protectors.

Specifically, the two pivot pins 2, 2' are configured such that upon a definable critical impact force transmitted via the coupling shaft 1 and via the elastomer spring mechanism 30 designed as a drawgear to the bearing block 20 being exceeded, the connection formed by the two pivot pins 2, 2' between the elastomer spring mechanism 30, respectively the housing shells 11, 11' of the elastomer spring mechanism 30, and the bearing block 20 is disengaged.

It is thereby provided for each pivot pin 2, 2' to comprise a respective bearing disc 3, 3' as well as a respective shearing element 4, 4'. A concentrically arranged recess 5, 5' is in each case formed in the respective bearing discs 3, 3' of the pivot pins 2, 2' for receiving the respective bearing block-side region 6, 6' of the shearing element 4, 4'.

On the other hand, a pin seat 7, 7' particularly in the form of a corresponding recess is in each case formed in the respective housing shells 11, 11' of the elastomer spring mechanism 30. Said pin seat 7, 7' receives a linkage-side region 8, 8' of the corresponding shearing element 4, 4'.

A breaking or separating region 9, 9' is provided between the bearing block-side region 6, 6' and the linkage-side region 8, 8' of each shearing element 4, 4'. In other words, the breaking or separating region 9, 9' of each shearing element 4, 4' divides the respective shearing element 4, 4' into a bearing block-side region 6, 6' and an opposing linkage-side region 8, 8'.

The breaking or separating region 9, 9' of the two shearing elements 4, 4' respectively integrated by way of the pivot pins 2, 2' is designed as a groove introduced into the material of the shearing element 4, 4' in the embodiment depicted as an example in the figures. Specifically, and as can particularly be noted from the sectional depiction of the inventive device 100 shown in FIG. 2, the at least one groove is preferably designed as an internal groove, whereby particularly the bearing block-side region 8, 8' of the respective shearing element 4, 4' is of at least partially hollow configuration to that end. The internal groove can preferably be introduced into the material of the shearing element 4, 4' as a recess.

Although not depicted in the figures, it is however of course also conceivable for the breaking or separating region 9, 9' to be designed as a groove introduced into the outer surface of the respective shearing element 4, 4'. Even if this may be advantageous in terms of the production of the shearing element 4, 4' and particularly in terms of the formation of the breaking or separating region 9, 9' of the shearing element 4, 4', it is of advantage to provide at least one internal groove for the formation of the breaking or separating region 9, 9' in order to reduce the bending slot tensions which occur.

Of course other solutions for forming the breaking or separating region 9, 9' in which the material of the shearing element 4, 4' is accordingly weakened in the breaking or separating region 9, 9' are however also conceivable.

As can particularly be seen from the sectional representation in FIG. 2, the shearing elements 4, 4' are each of rotationally symmetric configuration, whereby the vertical rotation axis R defined by the bearing block shells 23, 24 aligns with the corresponding symmetry axes of the shearing elements 4, 4'.

The bearing discs 3, 3' likewise associated with the respective pivot pins 2, 2' are formed in each case with a recess 5, 5' facing the respective housing shells 11, 11' in which the bearing block-side region 6, 6' of the associated shearing element 4, 4' is respectively accommodated.

The region of the bearing shell 3, 3' extending radially from the respective recess 5, 5' is also referred to herein as the "peripheral edge 12, 12" of the respective bearing shell 3, 3'. On the other hand, the end face of the respective bearing disc 3, 3' opposite from the end face of the bearing disc 3, 3' in which the respective recess 5, 5' is formed is referred to as "cylindrical plate region 13, 13'."

As can particularly be seen from the FIG. 2 representation, the example embodiment of the inventive device 100 as depicted provides for the respective cylindrical plate regions 13, 13' of the bearing discs 3, 3' to exhibit a diameter which corresponds to the diameter of the peripheral edge 12, 12' of the bearing discs 3, 3'. However, in one alternative which is not shown in the drawings although is conceivable, the cylindrical plate region 13, 13' of the bearing disc 3, 3' has a larger diameter than the diameter of the peripheral edge 12, 12' of the bearing disc 3, 3'.

In the example embodiment of the inventive device 100 depicted in the drawings, the bearing disc 3, 3' of each pivot pin 2, 2' is accommodated in the respective bearing block shell 23, 24 of the upper/lower bearing block arm 21, 22. Use is thereby preferably made of a floating bearing in which at least one region of the peripheral edge 12, 12' of the respective bearing disc 3, 3' forms a sliding surface for the pivot bearing formed with the respective bearing block shell 23, 24.

In order to position the pivot pin 2, 2' or the corresponding bearing disc 3, 3' of the pivot pin 2, 2' respectively which is thus in floating fit in the corresponding bearing block shell 23, 24, the embodiment depicted as an example in the drawings provides for each bearing shell 23, 24 of the bearing block to be allocated a respective cover 26, 26'. This cover 26, 26' is preferably detachably connected to the respective bearing block arm 21, 22 via bolts 27, 27' such that the bearing shell 23, 24 of the bearing block arm 21, 22 on the one side and the cover 26, 26' enclose a volume in which the bearing disc 3, 3' of the respective pivot pin 2, 2' is supported.

In the embodiment of the inventive device 100 depicted as an example in the drawings, the impact forces transmitted from the coupling shaft 1 to the housing shells 11, 11' of the elastomer spring mechanism 30 are transmitted to the bearing disc 3, 3' associated with the shearing element 4, 4' via the shearing element correspondingly supported in the pin seat 7, 7' formed in the housing shell 11, 11' and, from there, into the respective bearing block shell 23, 24 or respective bearing block arm 21, 22 respectively.

On the other hand, torque transmitted to the housing shells 11, 11' of the elastomer spring mechanism 30 upon the horizontal pivoting of the coupling shaft 1 is transmitted by the respective feather keys 14, 14' to the bearing disc 3, 3' and from there to the associated bearing block arm 21, 22 via the respective bearing shell 23, 24. Said feather keys 14, 14' are elongated components each lodged into a respective feather key groove 15, 15'.

Figure 3:
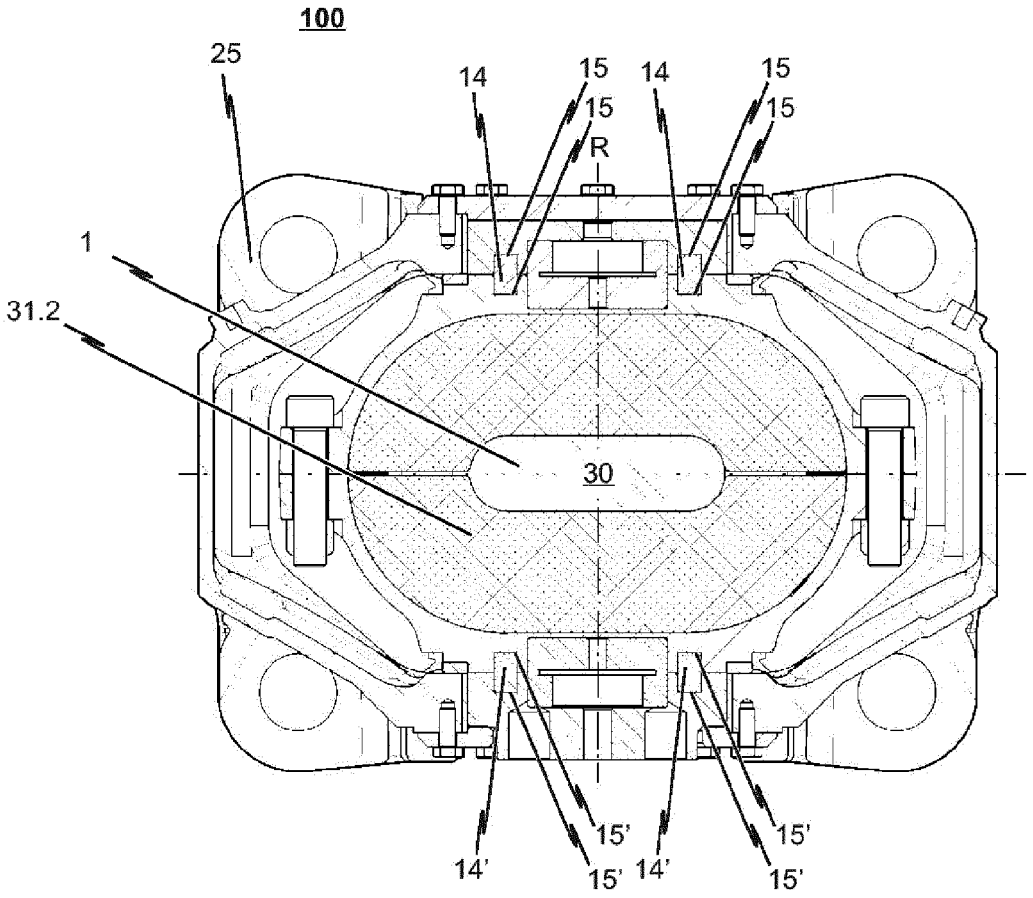
FIG. 3 the device according to FIG. 1 in a sectional view along the A-A line in FIG. 2.

As can particularly be noted from the sectional view as per FIG. 3, the feather keys 14, 14' are arranged to the side of the vertical rotation axis R, wherein each feather key groove 15, 15' is formed in the bearing disc 3, 3' on the one hand and in the housing shell 11, 11' on the other such that torque acting on the housing of the elastomer spring mechanism 30 upon the horizontal pivoting of the coupling shaft 1 is transmitted to the bearing disc 3, 3' via the feather key 14, 14' lodged in the feather key groove 15, 15'.

Although not explicitly depicted in the drawing, the respective feather key groove 15, 15' formed in the material of the housing shell 11, 11' is designed as a groove open toward the coupling shaft so that after actuation of the respective shearing elements 4, 4', the housing of the elastomer spring mechanism 30 can move in the direction of the car body relative to the bearing block 20.

In order for the coupling shaft 1 and in particular the elastomer spring mechanism 30 at the rear end region of the coupling shaft 1 to be removed from the flow of force transmitted to the bearing block after the actuation of the pivot pins 2, 2 designed as shock protectors, the embodiment depicted in the drawings in particular provides for a corresponding opening to be formed in the flange region 25 of the bearing block 20 through which the elastomer spring mechanism 30 can be pressed upon activated shock protection, as the DE 20 2013 005 377 U1 printed publication, for example, describes in detail.

The feather key grooves 15, 15' extending in the direction of the coupling shaft are moreover accorded a guide function as they, together with the feather keys 14, 14' accommodated in the respective feather key grooves 15, 15', guide the movement of the elastomer spring mechanism 30 relative to the bearing block when displacing toward the car body.

Because the cover 26, 26' respectively allocated to a bearing block arm 21, 22 is fixedly connected to the bearing block arm 21, 22 by means of e.g. bolts 27, 27' in the solution according to the invention, there is no sealing point which even further simplifies the structure of the inventive device.

Figure 4:
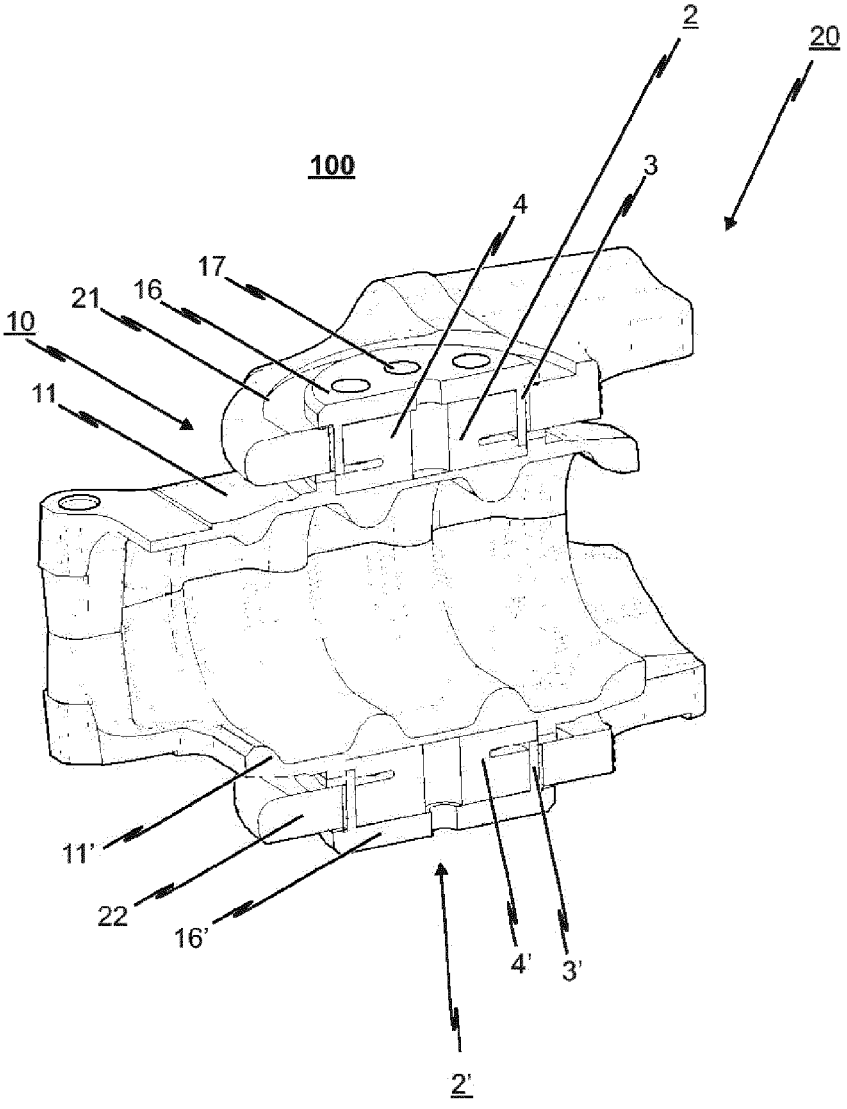
FIG. 4 an isometric and longitudinally sectioned representation of a second example embodiment of the device according to the invention.
Figure 5:
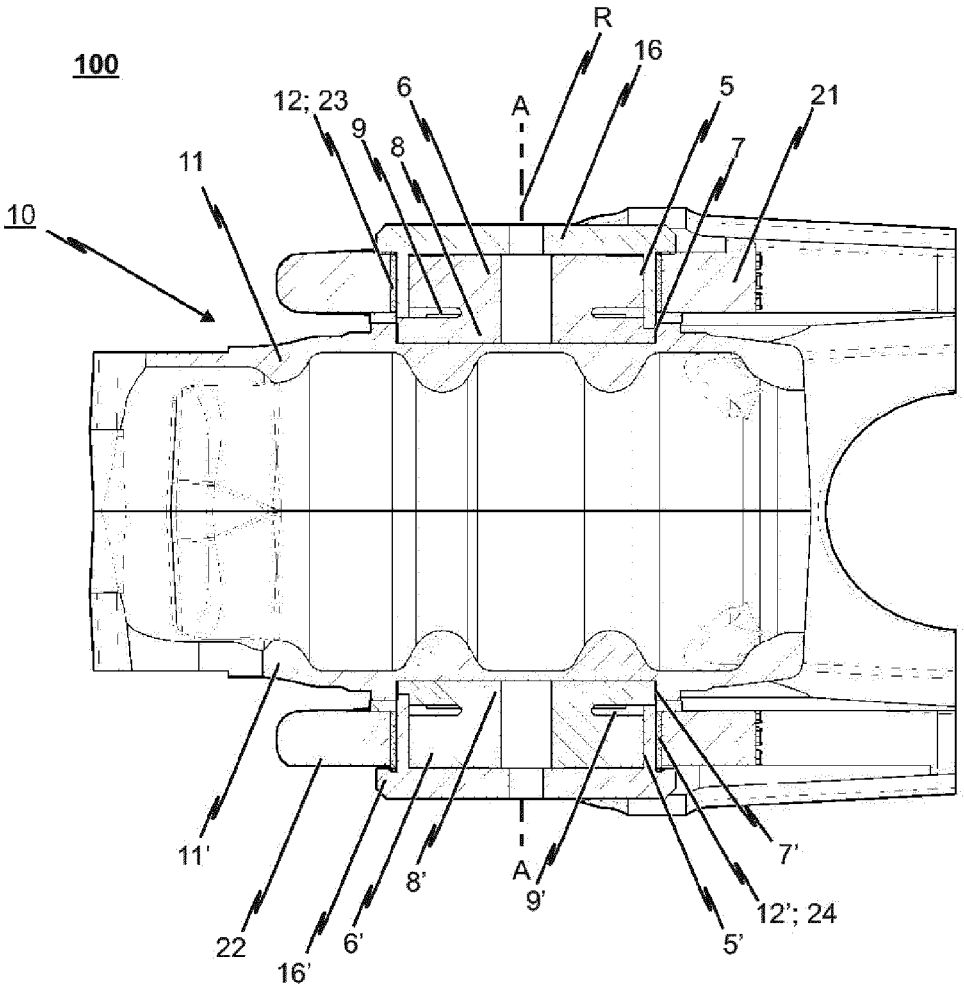
FIG. 5 the device according to FIG. 4 in a side sectional view.
Figure 6:
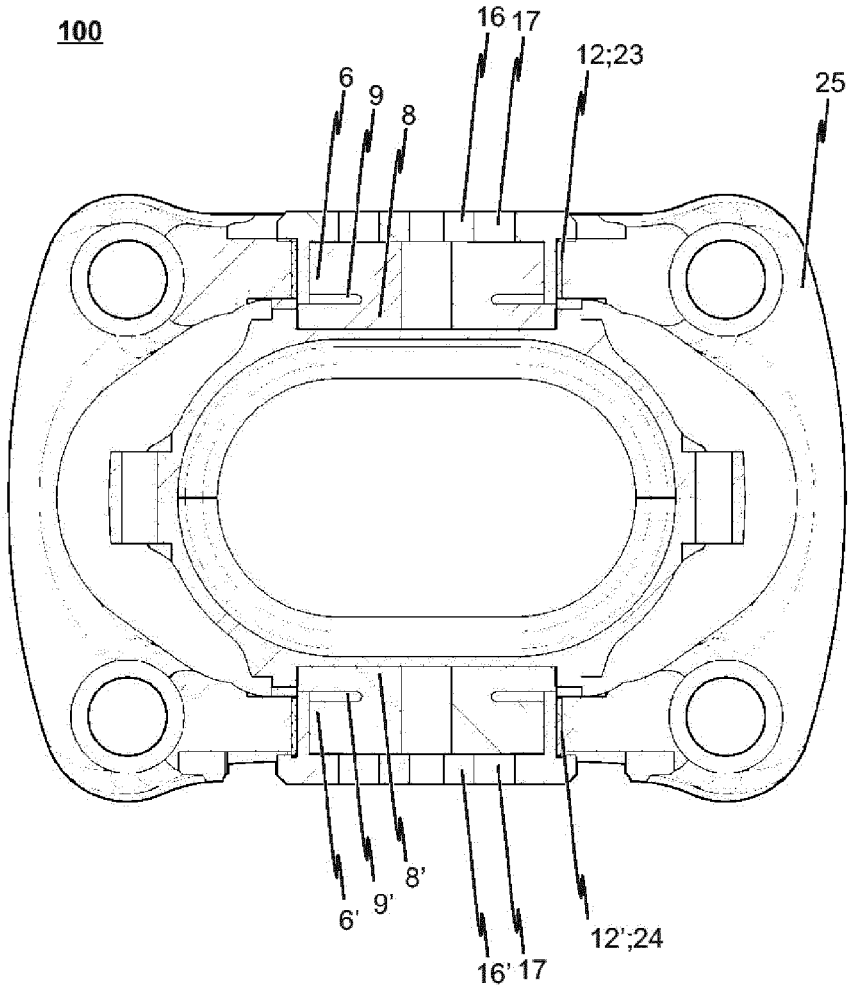
FIG. 6 the device according to FIG. 4 in a sectional view along the A-A line in FIG. 5.

Reference will be made below to the depictions provided in FIGS. 4-6 in describing a further (second) example embodiment of the inventive device in greater detail. Specifically, FIG. 4 shows the further example embodiment in an isometric and longitudinally sectioned representation, while FIG. 5 shows the device according to FIG. 4 in a side sectional view. FIG. 6 is a sectional view of the device according to FIG. 4 along the A-A line in FIG. 5.

The further example embodiment of the inventive device 100 for connecting a coupling shaft 1 to a car body of a track-guided vehicle comprises—likewise to the first example embodiment previously described—a linkage 10 connected to the car body-side end region of the coupling shaft 1 and a bearing block 20 connected or connectable to the car body. The linkage 10 is articulated to the bearing block 20 by an upper and a lower pivot pin 2, 2' so as to be pivotable in a horizontal plane.

As with the first embodiment of the inventive device 100 described above, the upper and lower pivot pin 2, 2' are each configured as shock protectors in the second example embodiment depicted in FIGS. 4 to 6, and namely in such a manner that upon the exceeding of a definable critical impact force transmitted via the coupling shaft 1 and the linkage 10 to the bearing block 20, the connection between the linkage 10 and the bearing block 20 formed by way of the upper and lower pivot pins 2, 2' is disengaged.

To that end, it is provided for the upper and lower pivot pin 2, 2' to comprise an upper and lower bearing disc 3, 3' which are relatively thin-walled compared to the first example embodiment as per FIGS. 1 to 3. Specifically, each bearing disc 3, 3' is respectively provided with a concentrically arranged recess 5, 5', whereby the diameter of the recess 5, 5' is somewhat smaller than the diameter of the bearing disc 3, 3'.

The upper and lower pivot pin 2, 2' in the second embodiment depicted in FIGS. 4 to 6 further comprise an upper and a lower shearing element 4, 4'. Each shearing element 4, 4' is provided with a respective breaking or separating region 9, 9'.

Specifically, and in contrast to the first example embodiment according to the representations of FIGS. 1 to 3, it is provided for each breaking or separating region 9, 9' of the shearing element 4, 4' to exhibit a groove introduced into the outer surface of the shearing element 4, 4' in the device 100 depicted in FIGS. 4 to 6. This groove, which defines the breaking or separating region 9, 9' of the respective shearing element 4, 4', divides the shearing element 4, 4' into a bearing block-side region 6, 6' and an oppositely disposed linkage-side region 8, 8'.

The bearing block-side region 6, 6' of the upper and lower shearing element 4, 4' is accommodated in the above-cited cylindrical recess 5, 5' of the bearing disc 3, 3'. The opposite linkage-side region 8, 8' of the upper and lower shearing element 4, 4' is on the other hand at least partially accommodated in a pin seat 7, 7' assigned to the upper and lower pivot pin 2, 2' and preferably connected by bolts.

As can be noted in particular from the sectional depiction in FIG. 5, a region of the peripheral edge 12, 12' of the bearing disc 3, 3' thus forms a sliding surface for a pivot bearing formed in the bearing block 20.

Furthermore to be noted from the FIG. 5 depiction is that the upper and lower bearing disc 3, 3' exhibits a cylindrical plate region at its end face opposite the linkage 10, the diameter of which is greater than the diameter of the peripheral edge 12, 12' of the bearing disc 3, 3' and greater than the diameter of the bearing shell 23, 24 associated with the pivot pin 2, 2'.

As previously indicated, the second example embodiment of the inventive device 100 in particular provides for the respective linkage-side regions 8, 8' of the upper and lower shearing element 4, 4' to be connected to the linkage 10 by means of at least one bolt or similar fixing element. In doing so, the at least one bolt should be of short enough overall length so as to not extend over the breaking or separating region 9, 9' of the respective shearing element 4, 4'.

Corresponding bores 17 are provided for the insertion of the bolts for connecting the linkage-side region 8, 8' of the shearing element 4, 4' to the linkage 10 (see FIG. 4), these extend through the cylindrical plate region 16, 16' of the upper/lower bearing disc 3, 3' and the bearing block-side 6, 6' of the respective shearing element 4, 4' (not depicted in the drawings).

The second embodiment of the inventive device 100 depicted in FIGS. 4 to 6 is further provided with zero-play tensile load protection.

Specifically, and as can be noted particularly from the sectional view in FIG. 5, the depth of the recess 5, 5' formed in the upper and lower bearing disc 3, 3' as well as the position of the breaking or separating region 9, 9' formed in the upper/lower shearing element 4, 4' is selected such that a car body-side region of the peripheral edge 12, 12' of the bearing disc 3, 3' does not cover the linkage-side region 8, 8' of the shearing element 4, 4', whereby however a coupling shaft-side region of the peripheral edge 12, 12' of the upper and lower bearing disc 3, 3' at least partly covers the linkage-side region 8, 8' of the shearing element 4/4'.

A zero-play tensile load protection is provided by way of this partial coverage area. The further structure and functioning of the second example embodiment of the inventive device 100 as depicted in FIGS. 4 to 6 corresponds substantially to the structure/functioning of the previously described first example embodiment so that to avoid repetition, a detailed description thereof will be omitted at this point.

The invention is not limited to the embodiment depicted in the drawings but rather yields from an integrated consideration of all the features disclosed herein in context.

In conjunction hereto, it is particularly conceivable for the breaking or separating region 9, 9' to not be formed by an internal groove but instead—as in for example the second example embodiment according to FIG. 4—to be formed by an external groove formed in the outer surface of the shearing element 4, 4'.

Alternatively or additionally thereto, it is conceivable for the bearing block-side region 6, 6' of a respective shearing element 4, 4' to be connected to the respective bearing disc 3, 3' by means of at least one bolt. At the same time, it is further conceivable for the linkage-side region 8, 8' of the shearing element 4, 4' to be connected to the housing of the elastomer spring mechanism 30 by means of at least one bolt. In principle, however, the at least one bolt should thereby in each case exhibit a short enough overall length so as not to extend over the breaking or separating region 9, 9' of the shearing element 4, 4'.

As depicted in the drawings (in particular FIG. 2), the depth of the recess 5, 5' formed in the respective bearing disc 3, 3' or the position of the breaking or separating region 9, 9' formed in the shearing element 4, 4' respectively is selected in the example embodiment of the inventive device 100 such that the peripheral edge 12, 12' of the bearing disc 3, 3' aligns with the breaking or separating region 9, 9' of the shearing element 4, 4' and in particular such that the peripheral edge 12, 12' of the bearing disc 3, 3' does not cover the linkage-side region 8, 8' of the shearing element 4, 4'. Doing so thus ensures that after activation of the shearing element 4, 4; i.e. when the bearing block-side region 6, 6' of the shearing element 4, 4' is separated from the linkage-side region 8, 8' of the shearing element 4, 4' at breaking or separating region 9, 9', the peripheral edge 12, 12' of the bearing disc does not obstruct the housing of the elastomer spring mechanism 30 from moving toward the car body relative to the bearing block 20.

However, it is in principle conceivable in this context for the peripheral edge 12, 12' to be configured in a coupling shaft-side region of the bearing disc 3, 3' so as to at least partly cover the linkage-side region 8, 8' of the shearing element 4, 4' in order to thereby provide tensile load protection. In this context, reference is in particular also made to FIG. 5.

LIST OF REFERENCE NUMERALS

1 coupling shaft
2, 2' pivot pin
3, 3' bearing disc
4, 4' shearing element
5, 5' recess
6, 6' bearing block-side region of shearing element
7, 7' pin seat
8, 8' linkage-side region of shearing element
9, 9' breaking or separating region
10 linkage
11, 11' housing shells
12, 12' peripheral edge of bearing disc
13, 13' cylindrical plate region of bearing disc
14, 14' feather key
15, 15' feather key groove
16, 16' cylindrical plate region
17 bore
20 bearing block
21 bearing block arm (upper)
22 bearing block arm (lower)
23 bearing shell of upper bearing block arm
24 bearing shell of lower bearing block arm
25 flange region of bearing block
26, 26' cover
27, 27' cover bolts
30 elastomer spring mechanism (drawgear)
31.1, 31.2, 31.3 spring elements
32 annular bead
33 annular bead
100 device
R vertical rotation axis

The invention claimed is:

1. A device for connecting a coupling shaft to a car body of a track-guided vehicle, wherein the device comprises:

a linkage connected to a car body-side end region of the coupling shaft; and a bearing block connected to the car body to which the linkage is articulated by at least one pivot pin to be pivotable in a horizontal plane, wherein the at least one pivot pin is a shock protector such that upon exceeding a definable critical impact force transmitted via the coupling shaft and the linkage to the bearing block, a connection between the linkage and the bearing block formed by the at least one pivot pin is disengaged, wherein the at least one pivot pin further comprises a bearing disc having a concentrically arranged recess and a shearing element having a separating region, wherein the separating region divides the shearing element into a bearing block-side region and an oppositely disposed linkage-side region, wherein the bearing block-side region of the shearing element is at least partly accommodated in or connected to the recess of the bearing disc, and wherein the linkage-side region of the shearing element is at least partly accommodated in or connected to a pin seat of the linkage associated with the at least one pivot pin.

2. The device according to claim 1, wherein at least one region of a peripheral edge of the bearing disc forms a sliding surface for a pivot bearing formed in the bearing block.

3. The device according to claim 1, wherein at least one feather key is inserted in an elongated feather key groove extending parallel to a direction of the coupling shaft, wherein the feather key groove is configured in the bearing disc on a first side of the at least one feather key and in the linkage on a second side of the at least one feather key such that the feather key lodged in the feather key groove transmits torque acting on the linkage upon horizontal pivoting of the coupling shaft to the bearing disc.

4. The device according to claim 3, wherein the elongated feather key groove extending parallel to the direction of the coupling shaft and formed in the linkage is open in the direction of the coupling shaft.

5. The device according to claim 3, wherein two feather keys associated with the at least one pivot pin are provided and two elongated feather key grooves are provided, each of the two feather keys lodged in one of the two elongated feather key grooves laterally spaced from a vertical rotation axis (R) defined by the at least one pivot pin and extending parallel to the direction of the coupling shaft.

6. The device according to claim 1, wherein the bearing block further comprises a bearing shell allocated to the at least one pivot pin in which the bearing disc is at least partially supported in a floating bearing and at least one section of a peripheral edge of the bearing disc forms a sliding surface.

7. The device according to claim 6, wherein the bearing block further comprises a cover for the bearing shell allocated to the at least one pivot pin, wherein the cover is detachably connected to the bearing block such that the pivot pin is held in position.

8. The device according to claim 6, wherein the bearing disc further comprises a cylindrical plate region at an end face opposite the linkage, a diameter of is the cylindrical plate region greater than a diameter of a peripheral edge of the bearing disc and greater than a diameter of the bearing shell allocated to the pivot pin.

9. The device according to claim 1, wherein the bearing block-side region of the shearing element is connected to the bearing disc by at least one fixing element, and/or wherein the linkage-side region of the shearing element is connected to the linkage by at least one fixing element, wherein the at least one fixing element is in each case of short enough overall length to not extend over the separating region of the shearing element.

10. The device according to claim 1, wherein a depth of the recess formed in the bearing disc and/or a position of the separating region formed in the shearing element is selected such that at least a car body-side region of a peripheral edge of the bearing disc does not cover the linkage-side region of the shearing element.

11. The device according to claim 10, wherein a coupling shaft-side region of the peripheral edge of the bearing disc at least partly covers the linkage-side region of the shearing element.

12. The device according to claim 1, wherein the separating region of the shearing element further comprises at least one groove introduced into the shearing element.

13. The device according to claim 12, wherein the at least one groove is introduced into an outer surface of the shearing element.

14. The device according to claim 12, wherein the bearing block-side region and/or the linkage-side region of the shearing element is at least partially hollow, and wherein the at least one groove is an internal groove.

15. The device according to claim 1, wherein the recess formed in the bearing disc is of a circular cylindrical or a conical shape, and wherein the bearing block-side region of the shearing element has a respectively complementary shape.

16. The device according to claim 1, wherein the pin seat of the linkage associated with the at least one pivot pin is of a circular cylindrical or a conical shape, and wherein the linkage-side region of the shearing element has a respectively complementary shape.

17. The device according to claim 1, wherein a pair of pivot pins is provided and the bearing block further comprises an upper bearing shell and a lower bearing shell vertically spaced therefrom, and wherein the linkage is in each case connected to the upper bearing shell and the lower bearing shell of the bearing block by a respective one of the pair of pivot pins.

18. The device according to claim 17, wherein the bearing block further comprises a flange region, via which the upper bearing shell and the lower bearing shell are connected to an end face of the car body, wherein an opening is formed in the flange region, through which, upon the critical impact force being exceeded, at least part of the coupling shaft together with the linkage can be pressed and taken out of a flow of force transmitted to the bearing block.

19. The device according to claim 1, wherein the linkage further comprises an elastomer spring mechanism for damping tensile and impact forces transmitted via the coupling shaft to the linkage, and wherein the elastomer spring mechanism further comprises a housing articulated to the bearing block via the at least one pivot pin to be pivotable in the horizontal plane.

* * * * *